US005436529A

United States Patent [19]

Bobel

[11] Patent Number: 5,436,529

[45] Date of Patent: Jul. 25, 1995

[54] CONTROL AND PROTECTION CIRCUIT FOR ELECTRONIC BALLAST

[76] Inventor: Andrzej A. Bobel, 201 Norman Ct., Des Plaines, Ill. 60016

[21] Appl. No.: 52,224

[22] Filed: Apr. 22, 1993

Related U.S. Application Data

[63] Continuation-in-part of Ser. No. 11,971, Feb. 1, 1993, abandoned.

[51] Int. Cl.[6] ..... H05B 37/02

[52] U.S. Cl. ..... 315/127; 315/122; 315/125; 315/119; 315/106; 315/107

[58] Field of Search ..... 315/127, 119, 122, 125, 315/106, 107, 360

[56] References Cited

U.S. PATENT DOCUMENTS 3,084,294 4/1964 Grunwaldt .
4,461,980 7/1984 Nilssen .
4,616,158 10/1986 Krummel et al. .
4,710,682 3/1987 Zuchtriegel ..... 315/224
5,004,955 4/1991 Nilssen ..... 315/119
5,179,509 1/1993 Ling ..... 363/17

*Primary Examiner*—Benny Lee
*Assistant Examiner*—Reginald A. Ratliff
*Attorney, Agent, or Firm*—Hill, Steadman & Simpson

[57] ABSTRACT

A series-resonant ballast for powering at least one gas discharge lamp (16) having heatable filaments (12,15) includes: DC voltage input terminals (B+,B−); an oscillating resonant converter (55,26,51,52,53) for producing high frequency voltage for application to the gas discharge lamp; a control circuit (58) able to receive a control signal from the DC input terminals and from the resonant converter and operable to initiate and stop the oscillations; and direct current blocking circuits (57,50) coupled across the filaments (12,15) and operable to stop flow of the control signal from the DC input terminals, thereby the ballast will not oscillate and will not draw any power from the DC input terminals, whenever the gas discharge lamp is: (i) removed from the output terminals, (ii) is defective, or (iv) is inoperative.

18 Claims, 7 Drawing Sheets

CONTROL AND PROTECTION CIRCUIT FOR ELECTRONIC BALLAST

CROSS-REFERENCE TO RELATED APPLICATION

This application is a continuation-in-part of an earlier U.S. patent application Ser. No. 08/011,971 filed Feb. 1, 1993 now abandoned.

BACKGROUND OF THE INVENTION

It is common knowledge that application of a series-resonant inverter to power a gas discharge load is particularly ideal in regards to the inverter's matching properties with those of the gas discharge load. Especially, the properties like starting requirements and requirement of the waveform shape of the current supplied to the lamp load, are particularly favorable in respect to life duration of the lamp. (As described in U.S. Pat. No. 3,084,283 to Grunwaldt).

It is also known that in a series-resonant LC inverter, where the lamp load is connected across the resonant capacitor C, it is necessary to provide some means to protect the inverter from self-destruction, whenever the lamp fails to ignite or is removed out of its holders.

Furthermore, as is with all gas discharge lamp ballasts, the voltages required at the lampholders to start the lamps are so high as to potentially constitute a substantial electric shock hazard to persons having to service such ballasts.

To eliminate this hazard, whenever lampholders voltages exceed certain levels, protective measures have to be provided and shall be integrated in the ballast circuit design.

In the paper presented by McMurray, Shattuck: "Silicon-Controlled Inverter with Improved Commutation" at the AIEE Summer General Meeting, Ithaca, N.Y., Jun. 18–23, 1961, the authors described protection circuit for the series-resonant inverter with use of so called "feedback rectifiers" to return energy to a DC source. The most important drawback is that the inverter has large magnitude of current circulated within itself, thereby causing large power dissapation.

It will be most desirable to have a series-resonant inverter ballast circuit which (i) will not dissipate any power within itself when unloaded, and (ii) do not constitute a shock hazard to humans.

The circuits for protection of the series-resonant inverters have been described previously, notably in the following issued U.S. patents: U.S. Pat. No. 4,461,980 to Nilssen and U.S. Pat. No. 4,616,158 to Krummel et al.

In the Nilssen circuit, the ballast inverter is disabled within about one second after a lamp is removed from its lampholders, and the ballast is not taking any power, even though the power line voltage is applied. Whenever a new lamp is re-inserted, the power line voltage must be turned OFF and ON before the ballast will start the new lamp. It is a significant drawback and has not been accepted in the marketplace.

In the Krummel et al. circuit, the shut-off device provides for inverter shut-down in all abnormal load conditions. It also provides for strike of a new lamp after relamping without turning the power line voltage OFF and ON. After construction of the device for a power line voltage of 120 VAC, it has been discovered that the inverter's circulating current is of a large magnitude. The circulating current flows through the lamp filaments and filaments voltages are proportional to that current and are also very high. This drawback is significant and limits the invention's scope of applications.

Based on the background outlined above, it is highly desirable to have a series-resonant ballast for gas discharge lamps, which: (a) will not draw power from a power line source whenever lamps are removed or inoperative; (b) will strike new lamps after relamping without turning power line voltage OFF and ON; (c) can be adapted to any lamp type and power line voltage magnitude; (d) will be very simple and easily manufacturable with high repeatability; and (e) will be inexpensive.

SUMMARY OF THE INVENTION

In accordance with the invention, there is provided an energy conversion device employing an oscillating resonant converter, having DC input terminals and adapted for powering at least one gas discharge lamp having heatable filaments, and comprising:

- voltage source means able to provide constant or variable magnitude of a DC voltage between the DC input terminals;
- output terminals for connection to the filaments of the gas discharge lamp;
- one-shot trigger means coupled to the DC input terminals and to the resonant converter, and (i) able to receive a trigger control signal from the DC input terminals, and (ii) operable to provide one trigger pulse to effectively initiate the oscillations;
- one-shot disable means coupled to the DC input terminals and to the resonant converter, and (i) able to receive a disable control signal from the resonant converter, and (ii) operable to provide one disable pulse to effectively disable the oscillations; and
- direct current blocking means coupled to the output terminals and operable to stop flow of the trigger control signal from the DC input terminals.

It will be understood that such a device as outlined above will provide a series-resonant ballast for gas discharge lamps. The ballast will not draw any power from a power line source whenever lamps are removed or inoperative and will ignite new lamps after relamping, without turning power line voltage OFF and ON. The circuit of the device is simple, inexpensive, and can be adapted to any lamp type and power line voltage magnitude.

DESCRIPTION OF THE PREFERRED EMBODIMENTS

Figure 1:
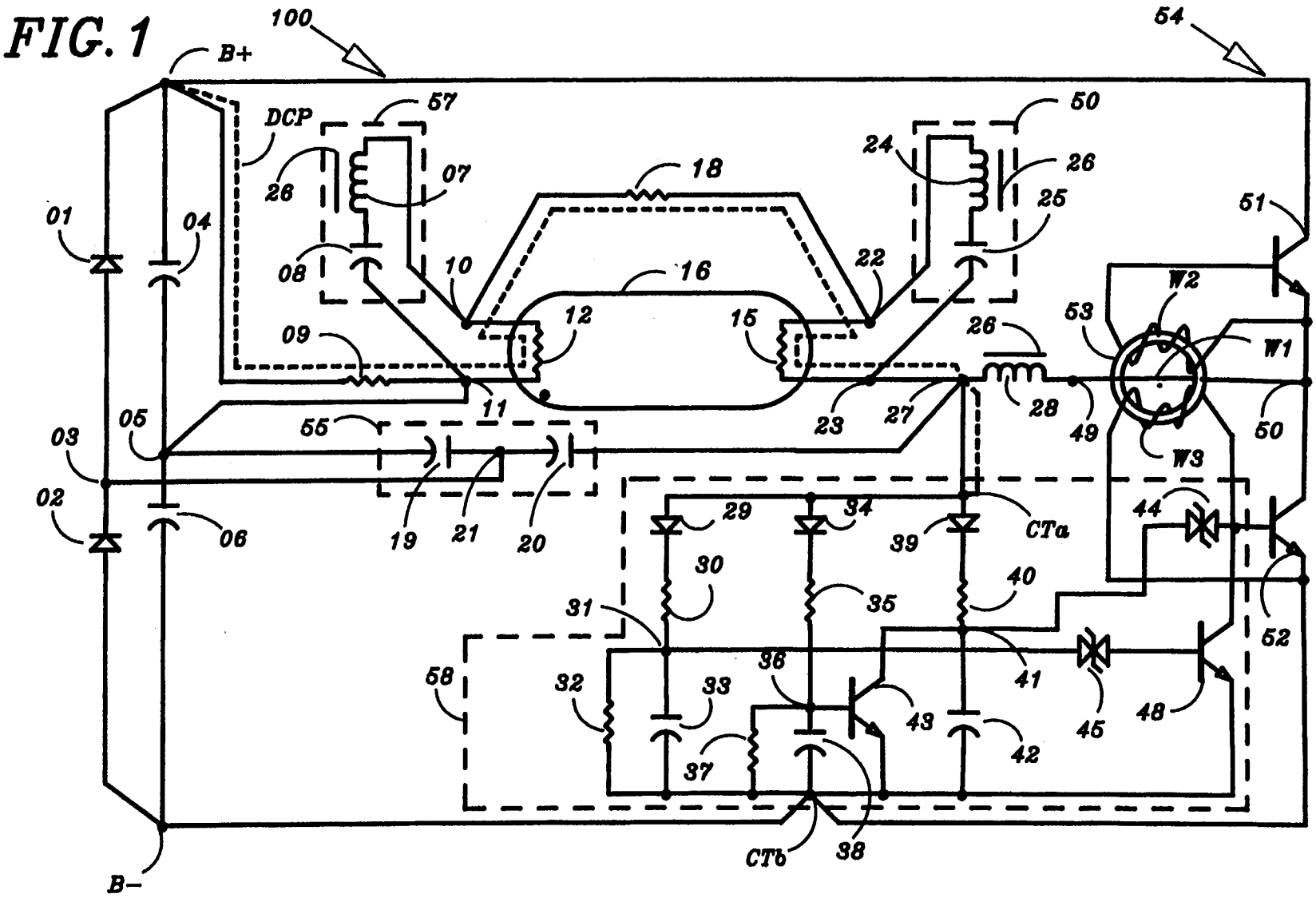
FIG. 1 schematically illustrates the invention in its first embodiment.

Referring now to FIG. 1, a circuit 100, for powering a fluorescent lamp 16, has two DC input terminals B+,B− for receiving thereacross a DC supply voltage of approximately 250 Volts. Two capacitors 04,06 (having equal values of approximately 47 uF) are connected in series between the DC input terminals B+,B− via a node 05.

A half-bridge inverter 54 has a bipolar transistor 51 (of the type MJE 13005) connected at its collector electrode to the positive DC input terminal B+. The transistor 51 has its emitter electrode connected to a node 50. A further transistor 52 (like the transistor 51, of the type MJE 13005) of the inverter 54 has its collector electrode connected to the node 50. The transistor 52 has its emitter electrode connected to the negative DC input terminal B−. A series-resonant circuit has a resonant capacitance 55 and a primary winding 28 of a resonant inductor 26 connected in series between the node 05 and a node 49 via an intermediate terminal 27.

A saturable feedback transformer 53 has a primary winding W1 (having one turn) and two secondary windings W2,W3 (each having approximately three turns) wound on a toroidal core. The primary winding W1 is connected in series with the primary winding 28 of the inductor 26, between the node 50 and the node 49. The secondary winding W2 is connected between a base electrode and the emitter electrode of the transistor 51. The secondary winding W3 is connected (with opposite polarity with respect to the secondary winding W2) between a base electrode and the emitter electrode of the transistor 52.

The resonant inductor 26 has secondary windings 07,24 magnetically coupled to the primary winding 28 and has an inductance value of the primary winding 28 equal to approximately 1.75 mH.

The resonant capacitance 55 consists of two series-connected capacitors 19,20 (having values of 47 nF and 18 nF respectively) via a node 21.

A diode 01 has its cathode connected to the terminal B+ and has its anode connected to the node 21. A further diode 02 has its cathode connected to the node 21 and has its anode connected to the terminal B−.

The fluorescent lamp 16 (as an ordinary rapid start lamp) has two heatable filaments 12,13 and two pairs of connecting terminals 10,11 and 22,23, respectively. The terminal 11 is connected to the node 05, and the terminal 23 is connected to the intermediate terminal 27.

A resistor 18 is connected between terminals 10 and 22.

A DC blocking circuit 57 has a series connected secondary winding 07 with a capacitor 08, and is connected across terminals 10,11 of the lamp 18.

A further DC blocking circuit 50 has a series connected secondary winding 24 with a capacitor 25, and is connected across terminals 22,23 of the lamp 18.

A control circuit 58 has three control terminals CTa, CTb and CTc. The terminal CTa is connected to the intermediate terminal 27; the terminal CTb is connected to the terminal B−; and the terminal CTc is connected to the base electrode of the transistor 52.

The control circuit 58 has a first series current path between terminals CTa,CTb, and the path has a diode 39, a resistor 40, and a capacitor 42 connected in series, via a node 41 formed between the resistor 40 and the capacitor 42. A diac 44 is connected between the node 41 and the terminal CTc. A small signal npn transistor 43 is connected with its collector electrode to the node 41, and with its emitter electrode to the terminal CTb.

The control circuit 58 has a second series current path between terminals CTa,CTb, and the path has a diode 34, a resistor 35, and a capacitor 38 connected in series via a node 36 formed between the resistor 35 and the capacitor 38. The transistor 43 has its base electrode connected to the node 36. A resistor 37 is connected between the node 36 and the terminal CTb.

The control circuit 58 has a third series current path between terminals CTa,CTb, and the path has a diode 29, a resistor 30, and a capacitor 33 connected in series via a node 31 formed between the resistor 30 and the capacitor 33. A resistor 32 is connected to the node 31 and to the terminal CTb.

A small signal npn transistor 48 has its collector electrode connected to the terminal CTc and its emitter electrode connected to the terminal CTb. A diac 45 is connected between the node 31 and a base electrode of the transistor 48.

Figure 2:
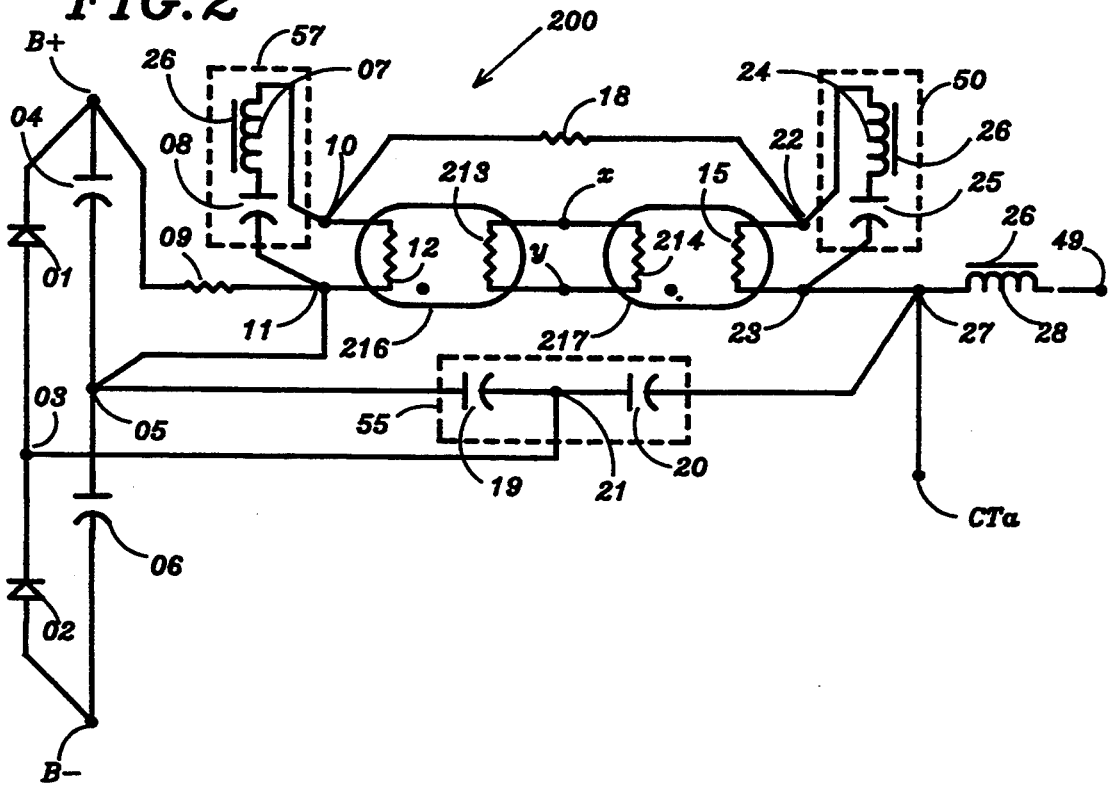
FIG. 2 is a fragmentary illustration of an alternative version of the device of FIG. 1.

Referring now to FIG. 2, a circuit 200 is a fragmentary illustration of the variation of FIG. 1. The fluorescent lamp 16 of the circuit 100 illustrated in FIG. 1, is replaced with two lamps 216,217 connected in series. Two additional terminals x,y are formed between these two lamps, due to parallel connection of two additional filaments 213,214, which are associated with these lamps.

Figure 3:
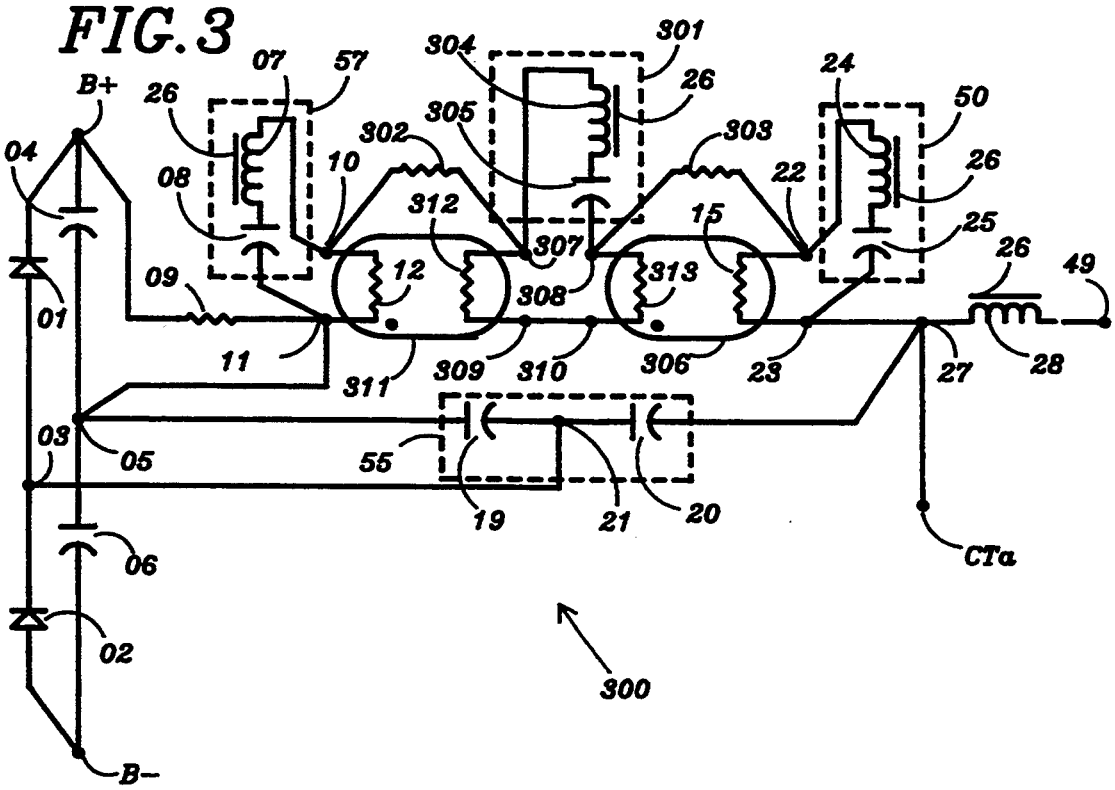
FIG. 3 is another fragmentary illustration of alternative version of the device of FIG. 1.

Referring now to FIG. 3, a circuit 300 is another alternative variation illustrated in circuit 100 of the FIG. 1. The fluorescent lamp 16 of FIG. 1 is replaced with two lamps 311,306. The lamp 311 has its two filaments 12,312 and two pairs of terminals 10,11 and 307,309 associated with the filaments, respectively. The lamp 306 has its two filaments 313,15 and two pairs of terminals 308,310 and 22,23 associated with the filaments respectively. The filaments 312 and 313 are connected in series by connecting the terminal 309 to terminal 310.

A DC blocking circuit 301 has a secondary winding 304 of the inductor 26 connected in series with a capacitor 307. The circuit 301 is connected between terminals 307,308.

A resistor 302 is connected between terminals 10,307, and another resistor 303 is connected between terminals 308,22.

The capacitor 08 of FIG. 1 can be replaced with a semiconductor diode having its cathode connected to terminal 1. Also, the capacitor 25 of FIG. 1 can be replaced with a semiconductor diode, having its anode connected to terminal 23.

Figure 4:
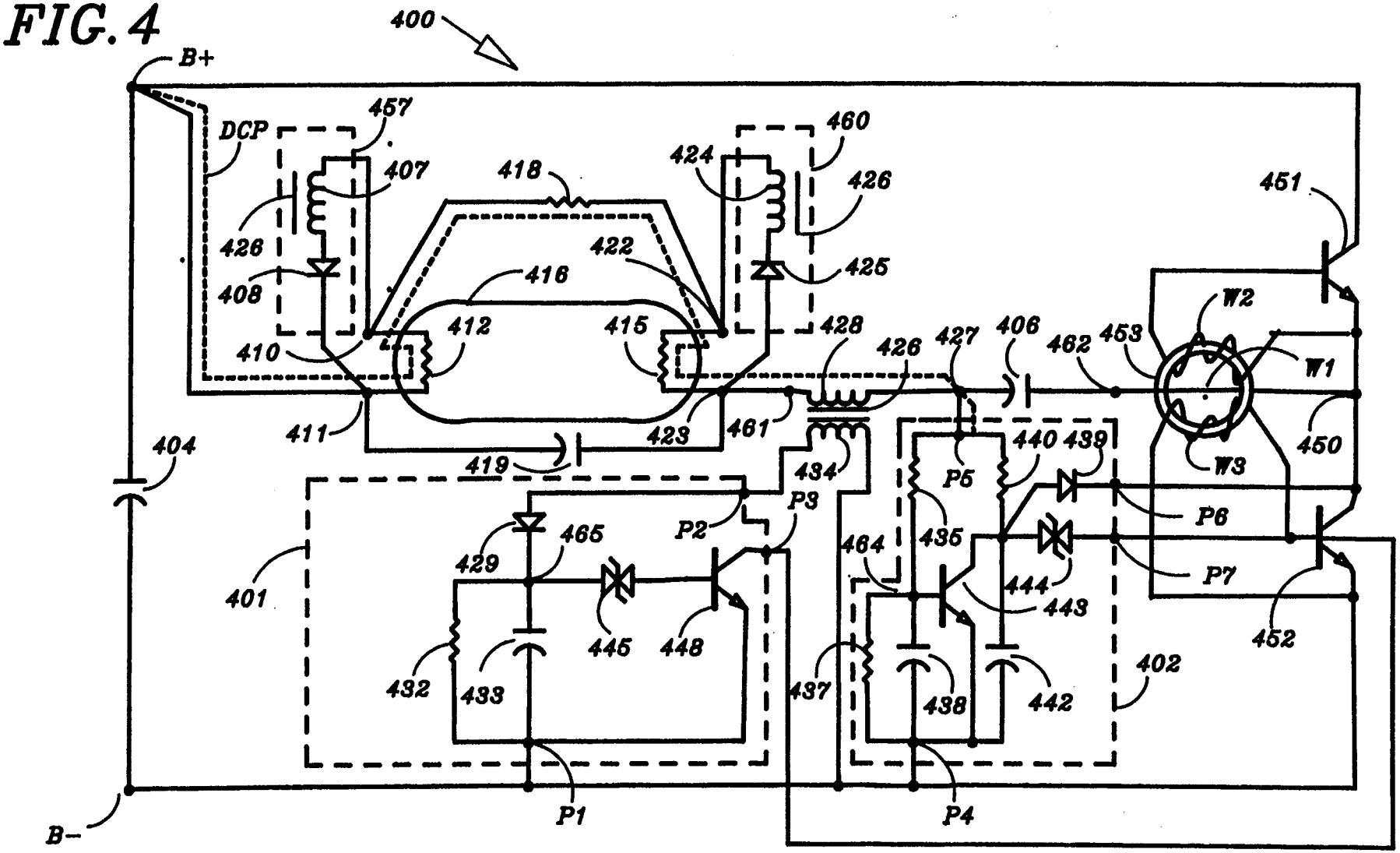
FIG. 4 schematically illustrates the invention in its second embodiment.

Referring now to FIG. 4, a circuit 400, for powering a fluorescent lamp 416, has two DC input terminals B+,B− for receiving thereacross a DC supply voltage.

A capacitor 404, (having value of approximately 47 uF) is connected between the DC input terminals B+,B−.

A half bridge inverter 454 has a bipolar transistor 451 connected at its collector electrode to the positive DC input terminal B+. The transistor 451 has its emitter electrode connected to a node 450. A further transistor 452 of the inverter 454 has its collector electrode connected to the node 450. The transistor 452 has its emitter electrode connected to the negative DC input terminal B−.

A series-resonant circuit has a resonant capacitance 419, a primary winding 428 of a resonant inductor 426, and a ballasting capacitor 406. All are connected in a series circuit between terminal B+ and the node 450 via intermediate terminals 461, 427, and 462, respectively.

A saturable feedback transformer made with a toroidal core 453 has a primary winding W1 (having one turn) connected in circuit with the primary winding 428, and has two secondary windings W2, W3 connected respectively to base-emitter junctions of the transistors 451 and 452.

The resonant inductor 426 has filament heating secondary windings 407, 424, and a disable sensing secondary winding 434 magnetically coupled with the primary winding 428.

The fluorescent lamp 416 (as an ordinary rapid start lamp) has two heatable filaments 412,415 and two pairs of connecting terminals 410,411 and 422,423, respectively. The terminal 411 is connected to the terminal B+, and the terminal 423 is connected to the intermediate terminal 461.

A DC current blocking circuit 457 has a series connected secondary winding 407 with a diode 408 and is connected across terminals 410, 411 of the lamp 416.

A further DC current blocking circuit 460 has a series connected secondary winding 424 with a diode 425 and is connected across terminals 422, 423 of the lamp 416.

A one-shot trigger circuit 402 has four pin-terminals P4,P5,P6 and P7. The pin-terminal P4 is connected to the terminal B−, the pin-terminal P5 is connected to the intermediate terminal 427 (and equivalently to the terminal 462 or terminal 461), the pin-terminal P6 is connected to the node 450, and the pin-terminal P7 is connected to a base electrode of the transistor 452.

The one-shot trigger circuit 402 has a first current path between pin-terminals P5 and P4, and the path has a resistor 440 and a capacitor 442 connected in series via a node 463. A diac 444 is connected between the node 463 and the pin-terminal P7. A small signal npn transistor 443 is connected with its collector electrode to the node 463, and with its emitter electrode to the pin-terminal P4. A diode 439 is connected between the node 463 and the pin-terminal P6.

The one-shot trigger circuit 402 has a second current path between pin-terminals P5 and P4, and the path has a resistor 435 and a capacitor 438 connected in series via a node 464. A resistor 437 is connected between the node 464 and the pin-terminal P4. Also, the small signal transistor 443 has its base electrode connected to the node 464.

A one-shot disable circuit 410 has an input pin-terminal P2, has an output pin-terminal P3, and has a ground pin-terminal P1. The disable sensing secondary winding 434 of the resonant inductor 426, is connected across pin-terminals P2 and P1. The output pin-terminal P3 is connected to a base electrode of the inverter transistor 452.

The one-shot disable circuit 401 has an input current path between pin-terminals P2 and P1, and the path has a diode 429 and a capacitor 433 connected in series via a node 465. A resistor 432 is connected between the node 465 and the pin-terminal P1. An output transistor 448 has its collector electrode connected to the pin-terminal P3, and has its emitter electrode connected to the ground pin-terminal P1. A diac 445 is connected between the node 465 and a base electrode of the transistor 448.

Figure 5:
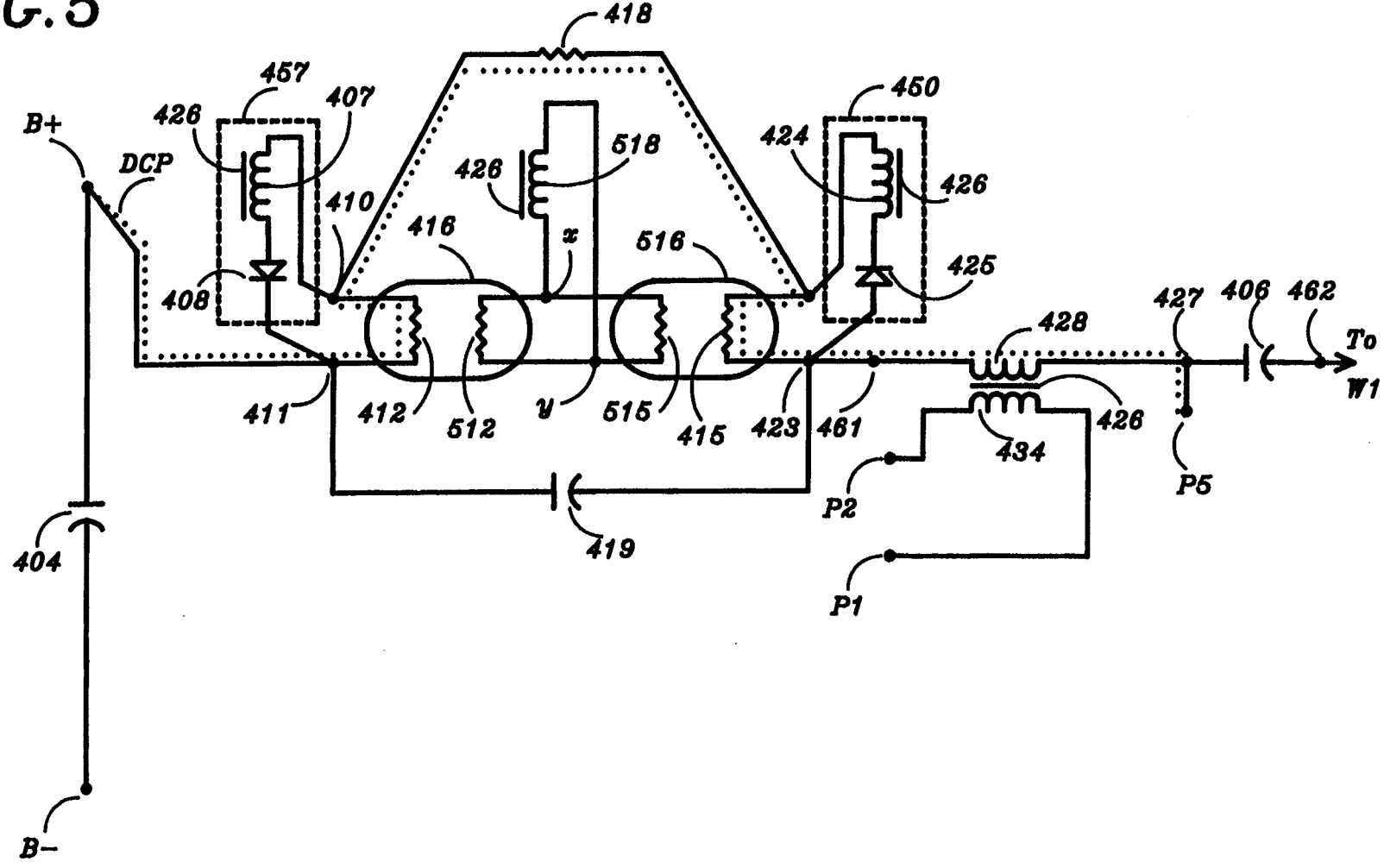
FIG. 5 is a fragmentary illustration of an alternative version of the device of FIG. 4.

Referring now to FIG. 5, a circuit 500 is a fragmentary illustration illustrated in variation of circuit 400 of the FIG. 4. An additional lamp 516 is connected in series with lamp 416. Two additional terminals x,y are formed between these two lamps, due to parallel connection of two additional filaments 512, 515, which are associated with these lamps. Also, an additional filament heating winding 518 is connected across the terminals x,y. The winding 518 is magnetically coupled with the resonant inductor 426.

Figure 6:
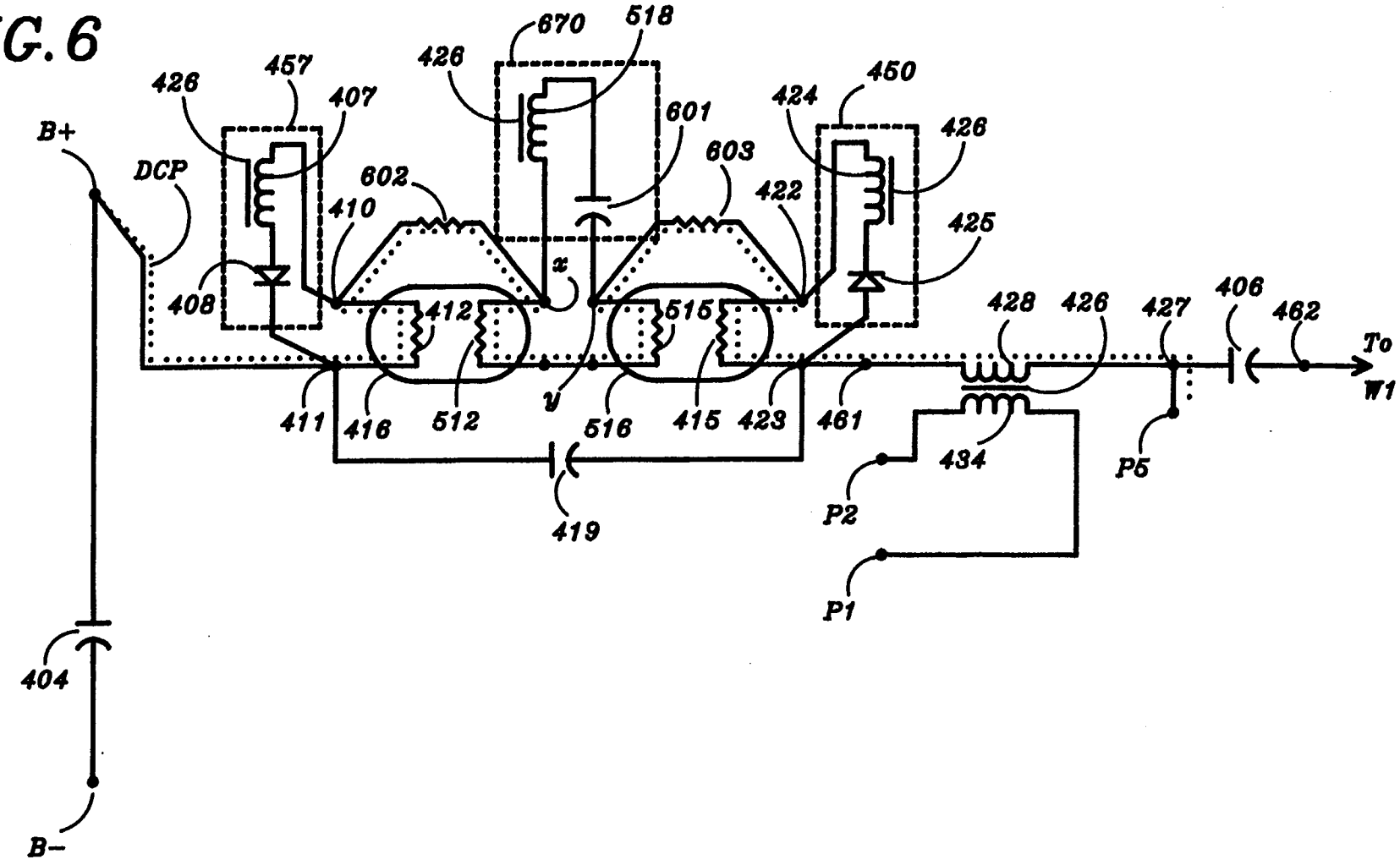
FIG. 6 is another fragmentary illustration of an alternative version of the device of FIG. 4.

Referring now to FIG. 6, a circuit 600 is a fragmentary illustration of circuit 500 illustrated in FIG. 5. The lamp 516 is connected in series with the lamp 416. Two additional terminals x,y are formed between these two lamps due to series connection of two additional filaments 512,515 which are associated with these lamps.

A DC current blocking circuit 670 as a the secondary winding 518 connected in series with a capacitor 601. The circuit 670 is connected between terminals x and y. A resistor 602 is connected between terminals 410 and x. A resistor 603 is connected between terminals y and 422.

Figure 7:
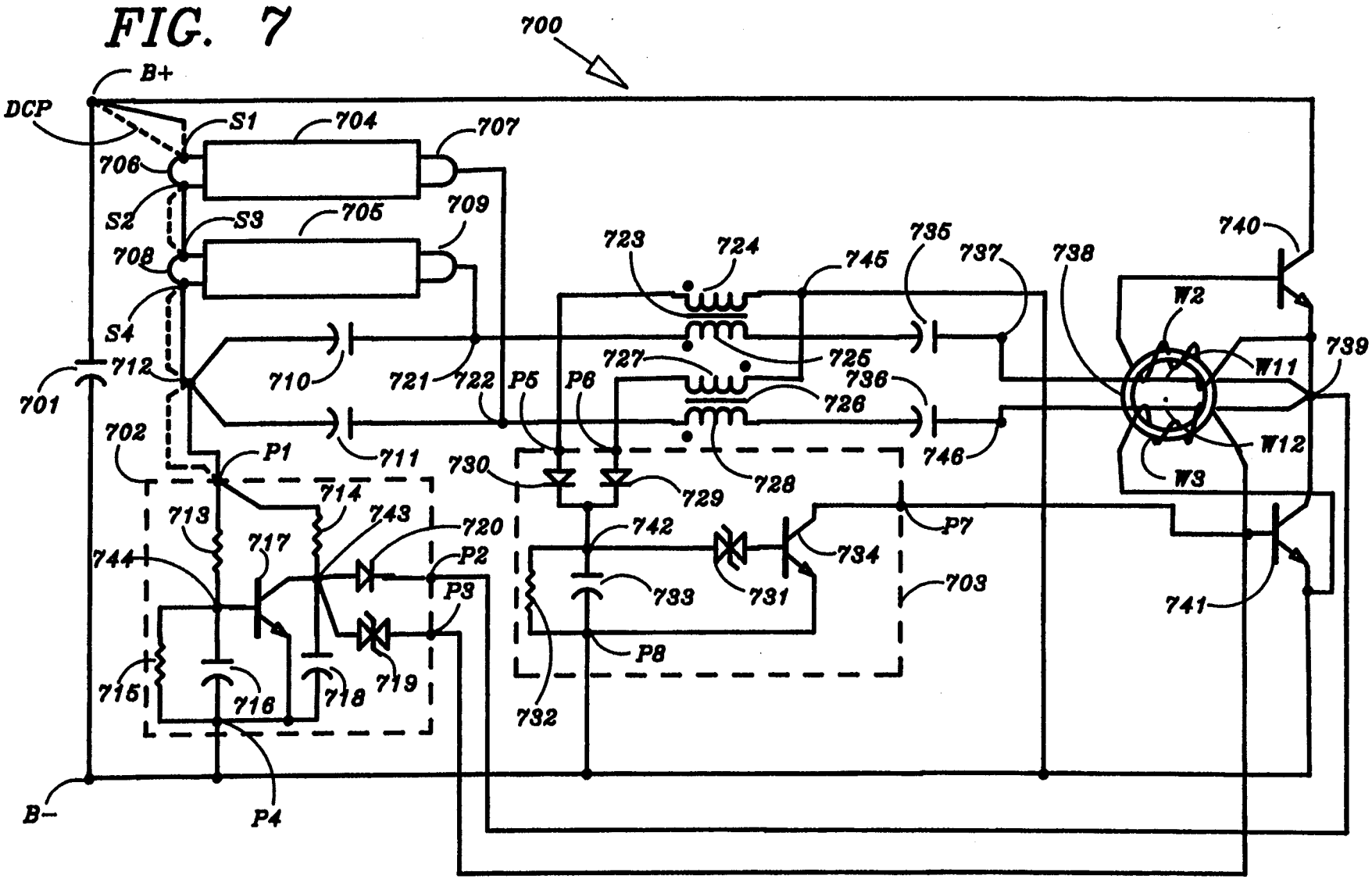
FIG. 7 schematically illustrates the invention in its third embodiment.
Figure 8:
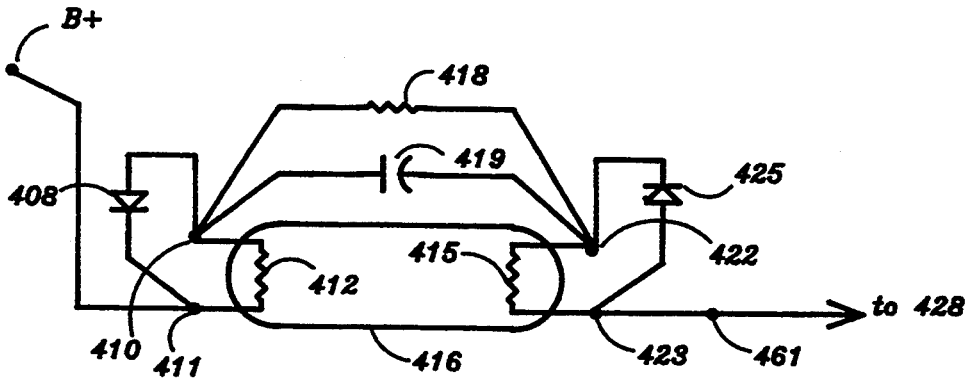
FIG. 8 is an alternative version of the device of FIG. 4.
Figure 9:
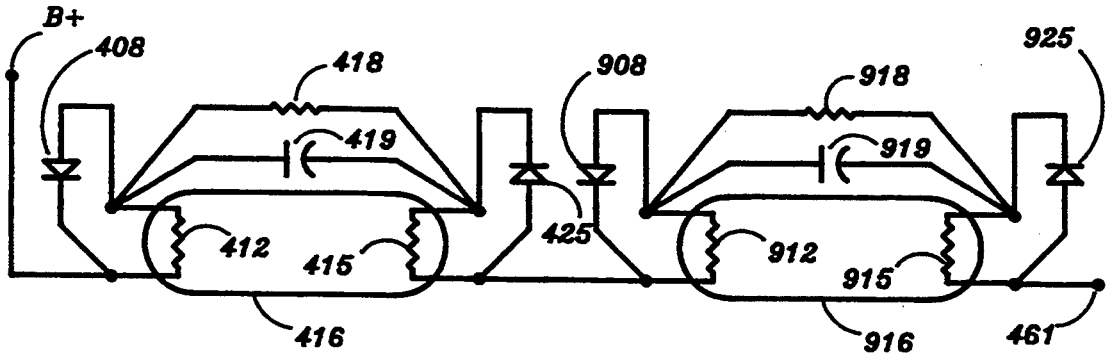
FIG. 9 is also an alternative version of the device of FIG. 4.

Referring now to FIG. 7, a circuit 700 for powering two fluorescent lamps 704, 705 has two DC input terminals B+,B− for receiving thereacross a DC supply voltage.

A capacitor 701 is connected between terminals B+,B−.

A half bridge inverter 750 has a bipolar transistor 740 connected at its collector electrode to the positive DC input terminal B+. The transistor 740 has its emitter electrode connected to a node 739. A further transistor 741 of the inverter 750 has its collector electrode connected to the node 739. The transistor 741 has its emitter electrode connected to the negative DC input terminal B−.

The fluorescent lamps 704 and 705 (as ordinary instant start type) have their ends equipped with conductive pin-type terminals 706,707 and 708,709, respectively. The terminals 706 and 708 are placed in circuit interrupting lampholders and contact terminals S1,S2 and S3,S4 associated with them respectively. A connection is provided between terminal B+ and an intermediate terminal 712 via: contact S1, pin-type terminal 706, contact S2, contact S3, pin-type terminal 708, and contact S4.

A first series-resonant circuit is connected between the intermediate terminal 712 and the node 739 and comprising serially connected: a capacitor 710, a primary winding 725 of the inductor 723, a capacitor 735, and a primary winding W11 associated with a feedback transformer 738.

A second series-resonant circuit is connected between the intermediate terminal 712 and the node 739 and comprising serially connected: a capacitor 711, a primary winding 728 of the inductor 726, a capacitor 736, and a primary winding W12 associated with the feedback transformer 738.

The terminal 707 of the lamp 704 is connected to intermediate node 721 formed between the capacitor 710 and the winding 725.

The terminal 709 of the lamp 705 is connected to intermediate node 722 formed between the capacitor 711 and the primary winding 728.

The feedback transformer 738 has secondary windings W2 and W3 connected to base-emitter junctions of the transistors 740 and 741, respectively.

A one-shot trigger circuit 702 has four pin-terminals P1,P2,P3 and P4. The pin-terminal P4 is connected to the terminal B−, the pin-terminal P1 is connected to the intermediate terminal 712, the pin-terminal P2 is connected to the intermediate node 739, and the pin-terminal P3 is connected to a base electrode of the transistor 741.

The one-shot trigger circuit 702 has a first current path between pin-terminals P1 and P4, and the path has a resistor 714 and a capacitor 718 connected in series via a node 743. A diac 719 is connected between the node 743 and the pin-terminal P3. A small signal npn transistor 717 is connected with its collector electrode to the node 743, and with its emitter electrode to the pin-terminal P4. A diode 720 is connected between the node 743 and the pin-terminal P2.

The one-shot trigger circuit 702 has a second current path between pin-terminals P1 and P4, and the path has a resistor 713 and a capacitor 716 connected in series via a node 744. A resistor 715 is connected between the node 744 and the pin-terminal P4. Also, the small signal transistor 717 has its base electrode connected to the node 744.

A one-shot disable circuit 703 has two input pin-terminals P5,P6, has an output pin-terminal P7, and has a ground pin-terminal P8. The resonant inductors 723, 726 are equipped with disable sensing secondary windings 724, 727, respectively. The windings 724 and 727 are polarized and connected in series (adding) mode via a node 745. The node 745 is connected to the ground pin-terminal P8. The windings 724 and 727 are connected to the input pin-terminals P5, P6, respectively. The output pin-terminal P7 is connected to a base electrode of the inverter transistor 741.

The one-shot disable circuit 703 has a first input current path between pin-terminals P5 and P8, and the path has a diode 730 and a capacitor 733 connected in series via a node 742. A resistor 732 is connected between the node 742 and the pin-terminal P8. The one-shot disable circuit 703 has a second current path between the pin-terminals P6 and P8, and the path has a diode 729 and the capacitor 733 connected in series via the node 742. An output transistor 734 has its collector electrode connected to the pin-terminal P7, and has its emitter electrode connected to the ground pin-terminal P8. A diac 731 is connected between node 742 and a base electrode of the transistor 734.

DETAILS OF OPERATION

Device of FIG. 1

Mode A

The device receives a DC voltage at the DC input terminals B+,B− and the capacitors 04,06 are charged to a magnitude approximately equal to one-half of the DC voltage. Then, DC current starts to flow in the direct current path DCP from terminal B+ through: resistor 09, filament 12, resistor 18, filament 15, diode 39, resistor 40 to charge the capacitor 42 within the time period of T1 associated with values of the resistors and the capacitor. Whenever the voltage across the capacitor 42 will reach a level above breakover voltage of the diac 44, the diac turns ON the transistor 52. An alternating current will start to flow in the resonant circuit which includes the resonant inductor 26 and the resonant capacitance 55. With a feedback signal provided by the saturable feedback transformer 53, the device will start to oscillate. The filaments 12 and 15 are heated by current flow resulting from application of voltages by the windings 07 and 24, respectively. A relatively high voltage is developed across both resonant elements. Whenever a magnitude of peak voltage between the nodes 21 and 05 reaches a level of the DC voltage present across the capacitor 04 or 06, the voltage applied to fluorescent lamp will be proportional to that voltage and is predetermined by a ratio of the values of the capacitors 19 and 20. The voltage applied to the lamp 16 causes the lamp to strike, and voltages across both resonant elements become lower accordingly. During the time period T1, a DC current will flow in another DC current path from terminal B+ through: resistor 09, filament 12, resistor 18, filament 15, diode 34, resistor 35 to charge capacitor 38 within a time period T2 dependent on values of the resistors in the path, value of the resistor 37, and value of the capacitor 38. When the voltage across the capacitor reaches a level sufficient enough to turn ON the transistor 43, the capacitor 42 will be held discharged for any time period as long as: (i) there is an unbroken direct current path DCP between terminal B+ and terminal CTa; (ii) the device oscillates and charging currents to the capacitors 42 and 38 are provided by an AC voltage potential associated with the intermediate terminal 27 in reference to terminal B−.

Mode B

While the device is operational as in Mode A, if the fluorescent lamp 16 is removed out of its holders, the AC voltage potential associated with the intermediate terminal 27 will rise, as this is natural behavior of the series-resonant circuit. A current will flow in the third series path of the control circuit 58 from terminal CTa through: diode 29, resistor 30, resistor 32 to charge capacitor 33 to a voltage level predetermined by values of the resistors in a predetermined time period associated with value of the capacitor 33. When the voltage across the capacitor 33 is greater than breakover voltage of the diac 45, the diac turns ON the transistor 48 for a brief period. As a result, the transistor 48 turns OFF the device and oscillations cease. The direct current path DCP between terminal B+ and terminal CTa is broken due to missing filaments 12,15 of the lamp 16. The DC current will not flow through DC blocking circuits 57, 50, and the starting capacitor 42 will not be charged. Thus, the device will never start to oscillate on its own.

Mode C

The fluorescent lamp 16 is now re-inserted into its holders, that will complete the direct current path DCP between terminal B+ and terminal CTa, and the device will start as in Mode A above.

The above modes of operation all apply to the circuit of FIG. 2 as the alternative version of the circuit of FIG. 1. The difference is the direct current path DCP is now associated with two lamps 216,217 connected in series. It will be enough to remove only one of the two lamps (as in Mode B), and the device will be turned OFF by the control circuit 58. Of course, it will be enough to re-insert that one lamp (as in Mode C) to provide for normal start-up and operation of the device.

Also, all above modes of operation apply to the circuit of FIG. 3 as another alternative version of the circuit of FIG. 1. The DC current path DCP between terminal B+ and terminal CTa is here associated with all four filaments 12, 312,313, and 15 of the two lamps 311, 306. The filaments are connected in series circuit in the path. It will be enough to remove at least one end of at least one lamp (as in Mode B), and the device will be turned OFF by the control circuit 58. Of course, it will be enough to re-insert that one end of the lamp (as in Mode C) to provide for normal start-up and operation of the device.

Operation of the Device of FIG. 4

Mode A

At power up, the direct current starts to flow in the direct current path DCP from terminal B+ through: filament 412, resistor 418, filament 415, winding 428, resistor 440 to charge capacitor 442. After predetermined time T1, when the voltage across capacitor 442 reaches a level high enough to cause the diac 444 to breakover, the transistor 452 is turned ON, and the device starts to oscillate. When the transistor 452 is turned ON periodically and alternately with the transistor 451, the charge from the capacitor 442 is removed with every oscillation cycle through diode 439. Also, the capacitor 438 is charged through a direct current path DCP and the resistor 435 to provide a signal to the base of the transistor 443. After a predetermined time T2, which is longer than T1, when the voltage across capacitor 438 will reach a level sufficient enough to turn ON the transistor 443, the trigger capacitor 442 will be held dicharged for any time period as long as: (i) there is an unbroken direct current path DCP between terminal B+ and the pin-terminal P5, and DC voltage is present at all times between terminals B+,B−; (ii) the device oscillating and charging currents to the capacitors 442 and 438 are provided by an AC voltage potential associated with the intermediate terminal 427 in reference to the terminal B−.

The trigger circuit 402 arranged as above provides only one trigger pulse per power-up, to initiate the oscillations of the device.

Mode B

While the device is operational as in Mode A, when the fluorescent lamp 416 is removed from its holders voltage magnitude across the winding 434 rises dramatically, as this is natural behavior of the series-resonant circuit. The sensing winding 434 provides charging current to the capacitor 433, and voltage across that capacitor rises. Whenever that voltage reaches a level high enough to breakover the diac 445, the transistor 448 is turned ON for a brief period, and oscillations of the device are stopped. The direct current path DCP between terminal B+ is broken due to missing filaments 412, 415 of the lamp 416. The direct current will not flow through DC blocking circuits 457,460, and the starting capacitor 442 of the trigger circuit 402 will never get charged. Thus, the device will never start to oscillate on its own.

Mode C

The fluorescent lamp 416 is now re-inserted into its holders, and that will complete the direct current path DCP between terminal B+ and the pin-terminal P5 of the trigger circuit 402, and the device will be triggered into oscillation as in Mode A.

The above modes of operation all apply to the circuit of FIG. 5 as the alternative version of the circuit of FIG. 4. The difference is that the direct current path DCP is now associated with two lamps 416,516 connected in series. It will be enough to remove only one of the two lamps (as in Mode B), and the oscillations of the device will be stopped by the one-shot disable circuit 401. Of course, it will be enough to re-insert that one lamp (as in Mode C) to provide for normal initiation of the oscillations and operation of the device as in Mode A.

Furthermore, all of the above modes of operation apply to the circuit of FIG. 6 as another alternative version of the circuit of FIG. 4. The direct current path DCP between terminal B+ and the pin-terminal P5 is here associated with all four filaments 412,512,515,415 of the two lamps 416,516. The filaments are connected in a series circuit path. It will be enough to remove at least one end of at last one lamp (as in Mode B), and the oscillations of the device will be stopped by a one-shot sensing circuit 401. Of course, it will be enough to re-insert that one end of the lamp (as in Mode C) to provide for normal initiation of the oscillations and operation of the device as in Mode A.

Operation of the Device of FIG. 7

Mode A

At power up, the direct current starts to flow in the direct current path DCP from terminal B+ through: internal and external wiring, contact S1, lamp pin-terminal 706, contact S2, contact S3, lamp pin-terminal 708, contact S4, and resistor 714 to charge trigger capacitor 718. After a predetermined time T1, when the voltage across capacitor 718 reaches a level high enough to cause the diac 719 to breakover, the transistor 741 is turned ON, and the device starts to oscillate. When the transistor 741 is turned 0N periodically and alternately with the transistor 740, the charge from the capacitor 718 is removed with every oscillation cycle through diode 720. Also, the capacitor 716 is charged through direct current path DCP and the resistor 713 to provide a signal to the base of the transistor 717. After a predetermined time T2, which is longer than T1, when the voltage across capacitor 716 will reach a level sufficient enough to turn ON the transistor 717, the trigger capacitor 718 will be held dicharged for any time period as long as there is an unbroken direct current path DCP between the terminal B+ and the pin-terminal P1 of the trigger circuit 702, and DC voltage is present at all times between the terminals B+,B−.

The trigger circuit 702 arranged as above provides only one relatively short trigger pulse per power-up of the device, to effectively initiate the oscillations.

Mode B

While the device is operational as in Mode A, when one of the lamps (704) is removed from its holders, voltage magnitude across winding 727 rises dramatically, as this is natural behavior of the series-resonant circuit. The sensing winding 727 provides a charging current to the capacitor 733, and voltage across that capacitor rises. Whenever that voltage reaches a level high enough to breakover the diac 731, the transistor 734 is turned ON for a brief period, and oscillations of the device are stopped. The direct current path DCP between the terminal B+ is broken due to missing lamp 704 and associated with it pin-terminal 706. The direct current will not flow in direct current path DCP, and the trigger capacitor 718 of the trigger circuit 702 will never get charged. Thus, the device will never start to oscillate on its own.

Mode C

The fluorescent lamp 704 is now re-inserted into its holders, and that will complete the direct current path DCP between terminal B+ and the pin-terminal P1 of the trigger circuit 702, and the device will be triggered into oscillation as in Mode A.

The circuit of FIG. 1 and all of its alternative variations, equipped with the control circuit and equipped with DC current blocking circuits coupled across at least one filament of at least one lamp provides for an ideally controlled series-resonant ballast for gas discharge lamps.

The control circuits, as described in the present invention, provide superb protection for the ballast in all fault modes like: starting lamps in very low temperatures, end of lamp life and all behaviors associated with it, power-up with, so-called, degased lamps and more.

Furthermore, the circuit of FIG. 4 and all of its alternative variations, equipped with one-shot trigger circuits and one-shot disable circuits, and equipped with DC blocking circuits coupled across at least one filament of at least one lamp, provide for an ideally controlled series-resonant ballast for gas discharge lamps.

The ballast constructed as described above (i) will not oscillate and will not draw any power from a supply voltage source whenever lamps are removed or inoperative; (ii) will ignite new lamps after relamping, without turning voltage source OFF and ON; (iii) can be adapted to any lamp type and any power line voltage magnitude; (iv) will be very simple, easily manufacturable and inexpensive.

It will be understood, that all other circuit arrangements, for example: one lamp type device similar to that described in FIG. 7 and equipped with the control circuit of FIG. 1, is an another alternative version, and is another embodiment of this invention.

It will be understood, that all other types of oscillatory circuits, either self-oscillatory or driven, half-bridge or full bridge type, fly-back, forward or Class E type—can be equipped with presently described control circuits, one-shot trigger, one-shot disable and DC blocking circuits, and all combinations thereof.

It is believed that the present invention and its several attendant advantages and features will be understood from the preceding description. However, without departing from the spirit of the invention,changes may be made in its form and in the construction and interrelationships of its components parts, the form herein presented merely representing the presently preferred embodiments.

I claim:

1. An energy conversion device employing an oscillating resonant converter producing oscillations, having DC input terminals producing a control signal and adapted to power at least one gas discharge lamp having heatable filaments, the device comprising:

voltage source means providing a constant or variable magnitude DC voltage between the DC input terminals;

output terminals connected to the filaments of the gas discharge lamp;

control means capable of receiving control signals from the DC input terminals and from the resonant converter, and operable to effectively initiate the oscillations, and to effectively stop the oscillations of the converter; and direct current blocking means coupled to the output terminals and operable to stop flow of the control signal from the DC input terminals, whenever at least one gas discharge lamp is removed from the output terminals or is defective.

2. The device according to claim 1 wherein the resonant converter comprises a capacitor and an inductor connected in series via an intermediate node.

3. The device according to claim 2 wherein the control means is connected to receive the control signal from the intermediate node.

4. The device according to claim 3 wherein the control means receives the control signal from the DC input terminals and the signal flows through the output terminals and the intermediate node.

5. The device according to claim 1 wherein the direct current blocking means includes a capacitor and is connected effectively across at least one heatable filament of at least one gas discharge lamp.

6. An energy conversion device employing oscillating resonant converter, having DC input terminals and adapted to power at least one gas discharge lamp having heatable filaments, and comprising:

voltage source means able to provide constant or variable magnitude of a DC voltage between the DC input terminals;

output terminals for connection to the filaments of at least one gas discharge lamp;

one-shot trigger means coupled to the DC input terminals and to the resonant converter, and (i) able to receive a trigger control signal from the DC input terminals, and (ii) operable to provide one trigger pulse to effectively initiate the oscillations;

one-shot disable means magnetically coupled to the resonant converter, and (i) able to receive a disable control signal from the resonant converter, and (ii) operable to provide one disable pulse to effectively stop the oscillations; and direct current blocking means coupled to the output terminals and effectively across at least one heatable filament of at least one lamp, and operable to stop flow of the trigger control signal from the DC input terminals, whenever at least one end of at least one lamp is removed from the output terminals or the lamp is defective.

7. Device according to claim 6 wherein the resonant converter comprises an inductor equipped with a primary winding and magnetically coupled secondary winding.

8. Device according to claim 7 wherein the one-shot trigger means receives the trigger control signal and the signal flows through the output terminals and the primary winding.

9. Device according to claim 7 wherein the one-shot disable means receives the disable control signal from the secondary winding of the inductor.

10. Device according to claim 6 wherein the direct current blocking means include a capacitor and are connected effectively across at least one heatable filament of at least one gas discharge lamp.

11. Device according to claim 6 wherein the direct current blocking means include a semiconductor diode and are connected effectively across at least one heatable filament of at least one gas discharge lamp.

12. An energy conversion device employing at least one oscillating resonant converter, having DC voltage input terminals, adapted to power at least one gas discharge lamp, and comprising:

voltage source means able to provide constant or variable magnitude of a DC voltage between the DC input terminals;

output terminals for connection to at least one gas discharge lamp;

one-shot trigger means coupled to the DC input terminals and to the output terminals, and (i) able to receive a trigger control signal from the DC input terminals, and (ii) operable to provide one trigger pulse to effectively initiate the oscillations;

one-shot disable means magnetically coupled to each and every one of the resonant converters, and (i) able to receive a disable control signal from each and every one of the resonant converters, and (ii) operable to provide one disable pulse to effectively stop the oscillations; and disconnect means coupled to the DC input terminals and to the output terminals, and operable to stop flow of the trigger control signal from the DC input terminals, whenever at least one gas discharge lamp is removed from the output terminals.

13. Device according to claim 12 wherein each an every one resonant converter is having an inductor equipped with a primary winding and magnetically coupled secondary winding.

14. Device according to claim 12 wherein the one-shot disable means receives the disable signal from the secondary winding.

15. Device according to claim 12 wherein the disconnect means comprises an internal and external wiring arranged to disconnect each and every one of the resonant converters from the DC input terminals whenever at least one lamp is removed from the output terminal.

16. Device according to claim 12 wherein the one-shot trigger means receives the trigger control signal, and the signal flows through the disconnect means and through the output terminal.

17. An energy conversion device employing at least one oscillating resonant converter, having DC input terminals and adapted to power at least one gas discharge lamp having heatable filaments, and comprising:

voltage source means able to provide constant or variable magnitude of a DC voltage between the DC input terminals;

output terminals for connection to the filaments of at least one gas discharge lamp;

one-shot trigger means coupled to the DC input terminals and to each and every one of the resonant converters, and (i) able to receive a trigger control signal from the DC input terminals, and (ii) operable to provide one trigger pulse to effectively initiate the oscillations;

one-shot disable means magnetically coupled to each and every one of the resonant converters, and (i) able to receive a disable control signal from each and every one of the resonant converters, and (ii) operable to provide one disable pulse to effectively stop the oscillations; and direct current blocking means coupled to the output terminals and effectively across at least one heatable filament of at least one lamp, and operable to stop flow of the trigger control signal from the DC input terminals, whenever at least one end of at least one lamp is removed from the output terminals or the lamp is defective.

18. An energy conversion device employing an oscillating resonant converter, having DC input terminals and adapted for powering at least one gas discharge lamp having heatable filaments, the device comprising:

voltage source means able to provide a constant or variable magnitude DC voltage between the DC input terminals;

output terminals for connection to the filaments of the gas discharge lamp;

control means able to receive control signals from the DC input terminals and from the resonant converter, and operable to effectively initiate the oscillations, and to effectively stop the oscillations of the converter; and direct current blocking means coupled to the output terminals and operable to stop flow of the control signal from the DC input terminals, whenever at least one gas discharge lamp is removed from the output terminals or is defective wherein the direct current blocking means includes a semiconductor diode and is connected effectively across at least one heatable filament of at least one gas discharge lamp.

* * * * *